US009006554B2

(12) United States Patent
Roberts et al.

(10) Patent No.: US 9,006,554 B2
(45) Date of Patent: Apr. 14, 2015

(54) HUMAN INTERFACE DEVICE WITH OPTICAL TUBE ASSEMBLY

(71) Applicants: Jody Roberts, Plano, TX (US); David Longenbaugh, Austin, TX (US)

(72) Inventors: Jody Roberts, Plano, TX (US); David Longenbaugh, Austin, TX (US)

(73) Assignee: Effigy Labs, Plano, TX (US)

( * ) Notice: Subject to any disclaimer, the term of this patent is extended or adjusted under 35 U.S.C. 154(b) by 291 days.

(21) Appl. No.: 13/780,719

(22) Filed: Feb. 28, 2013

(65) Prior Publication Data

US 2014/0238221 A1 Aug. 28, 2014

(51) Int. Cl.

| | |
|---|---|
| ***G10H 3/06*** | (2006.01) |
| ***G10H 1/055*** | (2006.01) |
| ***G10H 1/34*** | (2006.01) |

(52) U.S. Cl.

CPC ..... *G10H 3/06* (2013.01); *G10H 1/0553* (2013.01); *G10H 1/348* (2013.01); *G10H 2210/225* (2013.01); *G10H 2220/295* (2013.01); *G10H 2220/341* (2013.01)

(58) Field of Classification Search

CPC ..... H01L 2924/12041; H01L 2924/14; H01L 33/08; G06F 3/011; G06F 3/041; G06F 3/0325; G06F 3/0304; G06F 3/042; G06F 3/016; G06F 3/038; G06F 3/0428; G06F 3/16; G06F 3/0421; G06F 3/0414; G02B 6/241; G02B 6/262; G02B 7/00; G02B 6/0028; G02B 6/00

See application file for complete search history.

(56) References Cited

U.S. PATENT DOCUMENTS

| | | | |
|---|---|---|---|
| 3,317,649 | A | 5/1967 | Hearne |
| 4,837,857 | A | 6/1989 | Scheller et al. |
| 5,274,710 | A | 12/1993 | Shaffer et al. |
| 5,659,145 | A | 8/1997 | Weil |
| 5,905,220 | A | 5/1999 | Lee et al. |
| 6,859,541 | B1 | 2/2005 | Hilton |
| 7,357,539 | B2 | 4/2008 | Voelker |
| 7,476,799 | B2 | 1/2009 | Purchon et al. |
| 7,541,536 | B2 | 6/2009 | Daniel |
| 7,576,280 | B2 | 8/2009 | Lauffer |
| 7,589,273 | B2 | 9/2009 | Uehara |
| 7,598,450 | B2 | 10/2009 | Meeks |
| 7,598,686 | B2 | 10/2009 | Lys et al. |
| 7,642,448 | B2 | 1/2010 | Kato |
| 7,667,129 | B2 | 2/2010 | Chidlaw et al. |
| 7,674,968 | B2 | 3/2010 | Sasaki |
| 7,674,991 | B2 | 3/2010 | Baird et al. |
| 7,692,632 | B2 | 4/2010 | Logue |
| 7,767,902 | B2 | 8/2010 | Ludwig |
| 7,786,370 | B2 | 8/2010 | Ludwig |
| 7,894,615 | B1 | 2/2011 | McKiel, Jr. |
| 7,947,892 | B2 | 5/2011 | Crocker |
| 8,076,599 | B2 | 12/2011 | Mora |
| 8,084,681 | B2 | 12/2011 | Schon |
| 2004/0003708 | A1 | 1/2004 | Buchla |
| 2004/0200294 | A1 | 10/2004 | Tsay et al. |
| 2012/0144981 | A1 | 6/2012 | Ciccone |

*Primary Examiner* — Marlon Fletcher

(74) *Attorney, Agent, or Firm* — Klemchuk LLP; Kirby B. Drake

(57) ABSTRACT

A human interface device may include at least one analog control pressure surface that may operate in conjunction with at least one optical tube assembly (OTA) to allow precision human control of signal modulation, such as an audio signal being generated by a musical instrument. Each OTA may be incorporated within a body and may include a tube and an emitter-sensor pair wherein when pressure is applied to at least one of the pressure surfaces, the amount of light transferred within a sensor-emitter pair of an OTA is altered to selectively effect the signal modulation. Any type of control range may be expressed that depends on dynamic range and "touch" control. Accordingly, the human interface device may allow more "feeling" or expressiveness through application of pressure rather than positioning.

20 Claims, 11 Drawing Sheets

HUMAN INTERFACE DEVICE WITH OPTICAL TUBE ASSEMBLY

FIELD OF THE DISCLOSURE

The present disclosure generally relates to a human interface device, and more particularly to a human interface device with at least one optical tube assembly for precision control of signal modulation.

BACKGROUND

The basic designs and effects of pedals used to operate musical instruments and effect signal modulation have not changed much in decades. Current pedals are still based on rather unnatural and "low-resolution" motion. The pedals generally require four degrees of height, forcing the user's foot to come no closer than several inches from the floor. This position may become uncomfortable over time, forcing one to continue to be uncomfortable while playing, take a break, or switch feet. This height profile also presents difficulties to seated players from using the pedal with the same leg on which their instrument (such as a guitar) rests. Accordingly, operating the pedal bumps the instrument up and down unacceptably for most playing. Further, to learn to use these pedals takes not only an understanding of the application of the effect in a given musical style, but also time and practice to become accustomed to the mechanical action of the pedal itself. Improvements have generally focused on the electronics, with very little advancement in the mechanical motions. The user's foot must still continually and smoothly adjust to the curve around the fulcrum of the pedal, on the scale of motion of one to two inches.

SUMMARY

Embodiments of the present disclosure may provide a human interface device for precision control of signal modulation comprising a body formed of a durable elastomer capable of rapid compression and having a surface to receive contact from a user, and at least one optical tube assembly (OTA) embedded within the body, each OTA comprising a sensor and an emitter disposed within a soft tube, wherein pressure may be applied to one or more pressure surface areas disposed on the body to depress the soft tube within the OTA and obscure light from reaching the sensor of the OTA, and the amount of light received by the sensor selectively modulates the signal. The human interface device also may comprise a raw signal processor that may receive an input from the at least one OTA and output a sensor signal to a signal processing unit. The one or more OTAs may be mounted within the body through one or more techniques selected from the group comprising: hard candy technique, hair trigger technique, and wave shape technique. The soft tube may be formed of silicone rubber and may act as optical conduit wherein light received by the OTA may bend with the soft tube. The emitter may be a light-emitting diode (LED) that emits a bright focused radiant light at a peak sensitivity to be received by the sensor. The sensor may be a light-dependent resistor (LDR), photodiode or phototransistor that is sensitive to the same light emitted by the emitter. The body may be formed of platinum-cured or tin-cured silicone rubber (individually or collectively referred to as room-temperature vulcanization (RTV) silicone rubber). The human interface device also may include a sensitivity control that may adjust the size of a working range of sensitivity exposed to a user. A human interface device may control a device selected from the group comprising a musical instrument, a television, a remote control device using line-of-sight photonic signaling or an active IR attachment, a pedal, a plug-in, a DJ controller surface, and a MIDI controller surface. The human interface device may control the device via a connection selected from the group comprising a USB connection, an in-line connection, and a MIDI connection. The human interface device may be foot-operated or it may be a percussive surface.

Other embodiments of the present disclosure may provide a human interface device for precision control of signal modulation comprising a durable elastomeric body having at least one pressure surface to receive contact from a user, and more than one optical tube assembly (OTA) embedded within the body, each OTA associated with at least one of the at least one pressure surfaces and each OTA including a sensor-emitter pair disposed within a soft tube, wherein when pressure is applied to at least one of the pressure surfaces, the amount of light transferred within a sensor-emitter pair of an OTA may be altered to selectively effect the signal modulation. The human interface device may control a device selected from the group comprising a musical instrument, a television, a remote control device using line-of-sight photonic signaling or an active IR attachment, a pedal, a plug-in, a DJ controller surface, and a MIDI controller surface. There may be more pressure surfaces than there are sensor-emitter pairs within the human interface device. The OTAs and the body may be formed in a configuration selected from the following a diamond configuration, a foot configuration, a triangle configuration, a 2-lobe "alien" configuration, a square configuration, a tee configuration and a drum donut configuration. Each of the OTAs may be mounted within the body through a technique selected from the group comprising: hard candy technique, hair trigger technique, and wave shape technique. Each of the sensor-emitter pairs may be in one of the following states when pressure is applied to the body: open gate state, partial gate state, and full gate state. The body may be formed of platinum-cured or tin-cured silicone rubber. The at least one pressure surface may be colored differently than the remainder of the body.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a human interface device having an analog control pressure surface that may allow precision human control of signal modulation, such as an audio signal being generated by a musical instrument or a recording playback being controlled by a human. The user may control signal modulation or processing, especially of audio signals, with less ancillary motion and greater choice of range and sensitivity than has been previously provided through mechanical fulcrum-type pedals. Any type of control range may be expressed that depends on dynamic range and "touch" control, including but not limited to, common audio pedal effects processing such as gain (volume), tremoloed pitch bend ("whammy"), forward dynamic pass filtering ("wah"), backward dynamic pass filtering ("bow-wow"), and relative frequency alteration ("pitch bend"). Human interface devices according to embodiments of the present disclosure may allow users the same effect range in a much smaller range of motion and with a much lower profile to the floor. These devices may allow more "feeling" or expressiveness when compared to today's bulkier models in that they operate more based on pressure applied than positioning. The user is more easily able to "think" the effect they want and the human interface device may respond accordingly.

Embodiments of the present disclosure may allow more expressive, "high-resolution" articulation of an effect, including after touch-like effect and a good response curve than most existing fulcrum-type pedals today. The intended end experience for the user is for a human interface device according to embodiments of the present disclosure to be very easy and quick to learn to use and once learned, it "feels good" to the user. The human interface device may connect the user more to the thoughts and emotions that he/she wants to express and the device may insulate the user from as much "muscle memory" required to master traditional pedal operation as possible. In contrast to other pedals that are controlled by motion, human interface devices formed according to embodiments of the present disclosure may be controlled by slight pressure. As will be discussed further, the range of motion itself may be relatively negligible as a result (less than 1 cm) but the amount of pressure applied may fully control the output signal of the device. As such, a user of a human interface device according to embodiments of the present disclosure may better connect with his/her audience and with the music, and such a connection may be easier. It should be appreciated that any hardware or software interface may be connected to a signal path from the device according to embodiments of the present disclosure. It also should be appreciated that the human interface device may be embodied as a foot pedal but also may include hand-touch or other mechanism of operation without departing from the present disclosure.

Figure 1A:
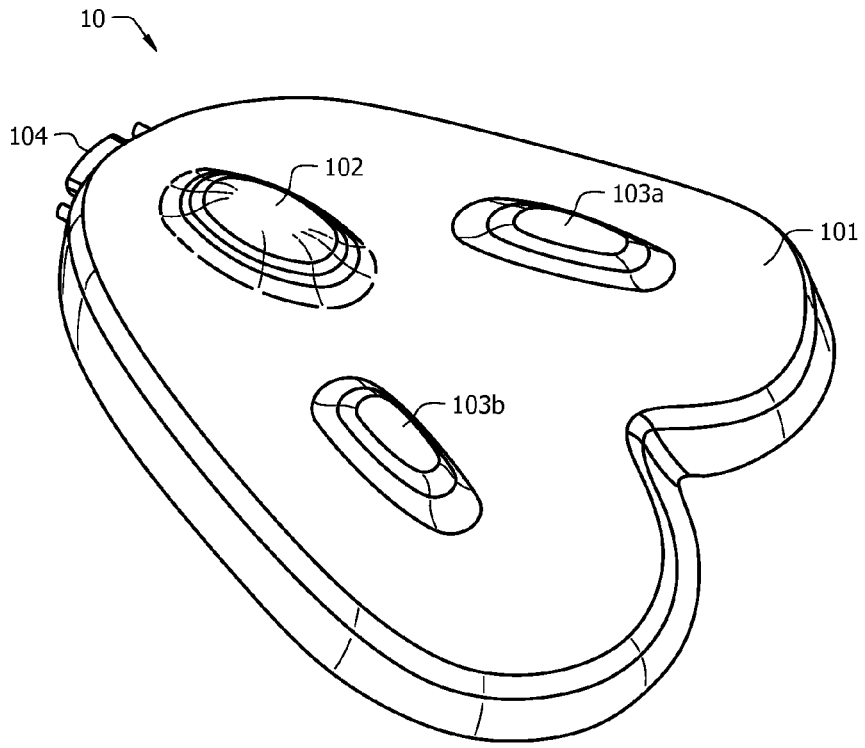
FIG. 1A depicts a human interface device according to an embodiment of the present disclosure.

FIG. 1A depicts human interface device 10 according to an embodiment of the present disclosure. Human interface device 10 may include body 101 presenting an operational pressure surface for a user. Body 101 may assist in focusing playing pressure and may provide a communication mechanism for the user. The body, when depressed by a human foot for example, may distend and obscure some fraction of the light reaching a sensor within an optical tube assembly (OTA) as will described in further detail below. The body may be formed in layers to allow for more durability as well as to provide a buffer between a human user contact and the inner layers, on the top and bottom of the body, and a softer, more elastic middle body completely surrounding one or more OTAs disposed within the body thereby providing a "squish" factor which promotes a more expressive range for human interaction.

Body 101 according to embodiments of the present disclosure may take advantage of analog elastic flexure to modulate an audio signal. The body may be comprised of a material that may provide for fine-grained human control. This may be a durable elastomer capable of rapid compression so that it may return to shape easily. It should be appreciated that the body may be formed in the shape of a slab, an ovoid semisphere or another shape having positional stability when placed on a flat surface, such as a floor, according to embodiments of the present disclosure. It should be appreciated that the height of the body may be in the range of approximately 1 inch according to embodiments of the present disclosure.

Body 101 may be formed of a soft material such as a platinum-cured (also called addition-cured) silicone rubber (PCSR). Tin-cured silicone rubber also may be employed according to some embodiments of the present disclosure. It is a very soft yet durable material and may provide sufficient properties to allow a desired range of distension of the one or more OTAs disposed within the body and yet still be practically durable to use in a normal environment. In an embodiment of the present disclosure, body 101 may be formed of Shore A 20 Addition-cure silicone rubber (amorphous siloxanes and the platinum and silicone elements) along with 1/32 powder solid color plus equal volume thinner to avoid overly thickening the mix, shortening the pot life and overly hardening the cured rubber. In another embodiment, 1/16 liquid color by volume may be added. In other embodiments of the present disclosure, glitter may be incorporated into the body or the body may be formed having a two-toned coloration, such as through use of thinners. It should be appreciated that body 101 may be formed of materials other than PCSR without departing from the present disclosure.

Body 101 may provide one or more optical tube assemblies (OTAs), such as OTAs 103*a*, 103*b* that may be disposed within body 101 but somewhat protruding from the top of body 101 as bumps, and body 101 may house and protect the one or more OTAs according to embodiments of the present disclosure. The OTA may be considered the heart of the human interface device around which the other components are built. Each of the one or more OTAs may comprise an emitter in one end and a sensor in the other end providing the sensing capability for the OTA. It should be appreciated that these bumps may be colored, such as having a yellow color, but they may be formed with different colors or even have the same coloring as body 101 according to embodiments of the present disclosure. Tubes forming the one or more OTAs may be filled with air and transmit light from an emitter to a sensor. As will be described in further detail below, by pressing or twisting the yellow bumps on body 101, the tubes may be pinched and closed off to some degree, thereby altering the amount of light that may reach a sensor within the tube. The sensor may be connected to an arbitrary signal path to effect modulation of live or recorded signal, such as an audio signal that may be produced by an electric guitar or plano. The OTAs may receive inputs such as pressure and voltage (+5V) and then output GND and/or raw signal according to embodiments of the present disclosure.

Bump 102 also may protrude from the top of body 101 and may be positioned in between OTAs 103*a*, 103*b* forming a triangular pattern according to embodiments of the present disclosure. It should be appreciated that human interface device 10 may include multiple OTAs or a single OTA without departing from the present disclosure. Further, the pattern in which the bumps may be positioned on the top of body 101 may be altered without departing from the present disclosure. In other embodiments of the present disclosure, the number of bumps on the top surface of the body may be more or fewer than the number of OTAs contained within the human interface device.

Figure 1B:
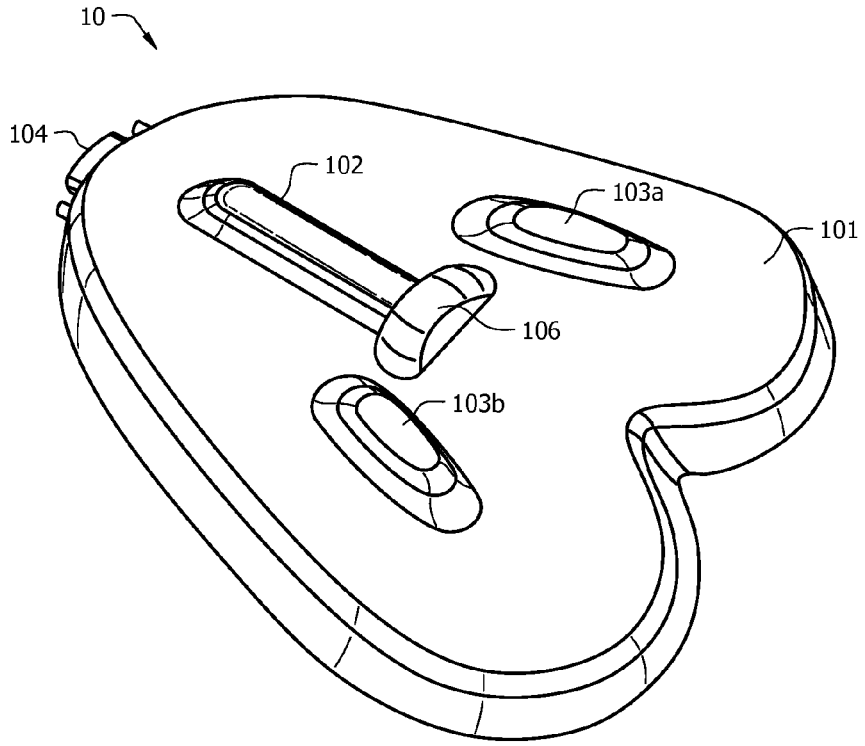
FIG. 1B depicts a human interface device according to an embodiment of the present disclosure.

Pivot bump 106 (see FIG. 1B) also may protrude from the top of body 101. Pivot bump 106 may be a raised arch and/or hard spot located in between OTAs 103*a*, 103*b* and just below bump 102. It may act as a non-visual reference so that the player's foot may quickly locate the correct position to operate the OTAs without needing to look down on device 10. Pivot bump 106 also may act as a rest point for the player's foot. The heel of the player's foot may rest on the floor in an embodiment of the present disclosure. The bottom of the player's foot may form a line from the heel to the toe, and the top of the pivot bump may lie along this line while the top portions of the OTAs may lie below this line. As such, the player may operate one or more OTAs without accidentally operating other OTAs. The player also may use the pivot bump by rocking back and forth to operate the OTAs in an alternating or reciprocating style or by operating one OTA by placing (or wedging) part of the player's foot in between the pivot bump and the OTA, thereby providing an extremely sensitive side feel. Accordingly, a very slight rock, twist or even a flex of the player's foot may operate the OTA.

Human interface device 10 may include receiver 104 that may receive a cable or other mechanism to provide power or electrical support to human interface device 10 according to embodiments of the present disclosure. A cable may be connected to receiver 104 so that device 10 may be connected, for example, to a MIDI pitch bend box or an electric guitar.

Figure 2A:
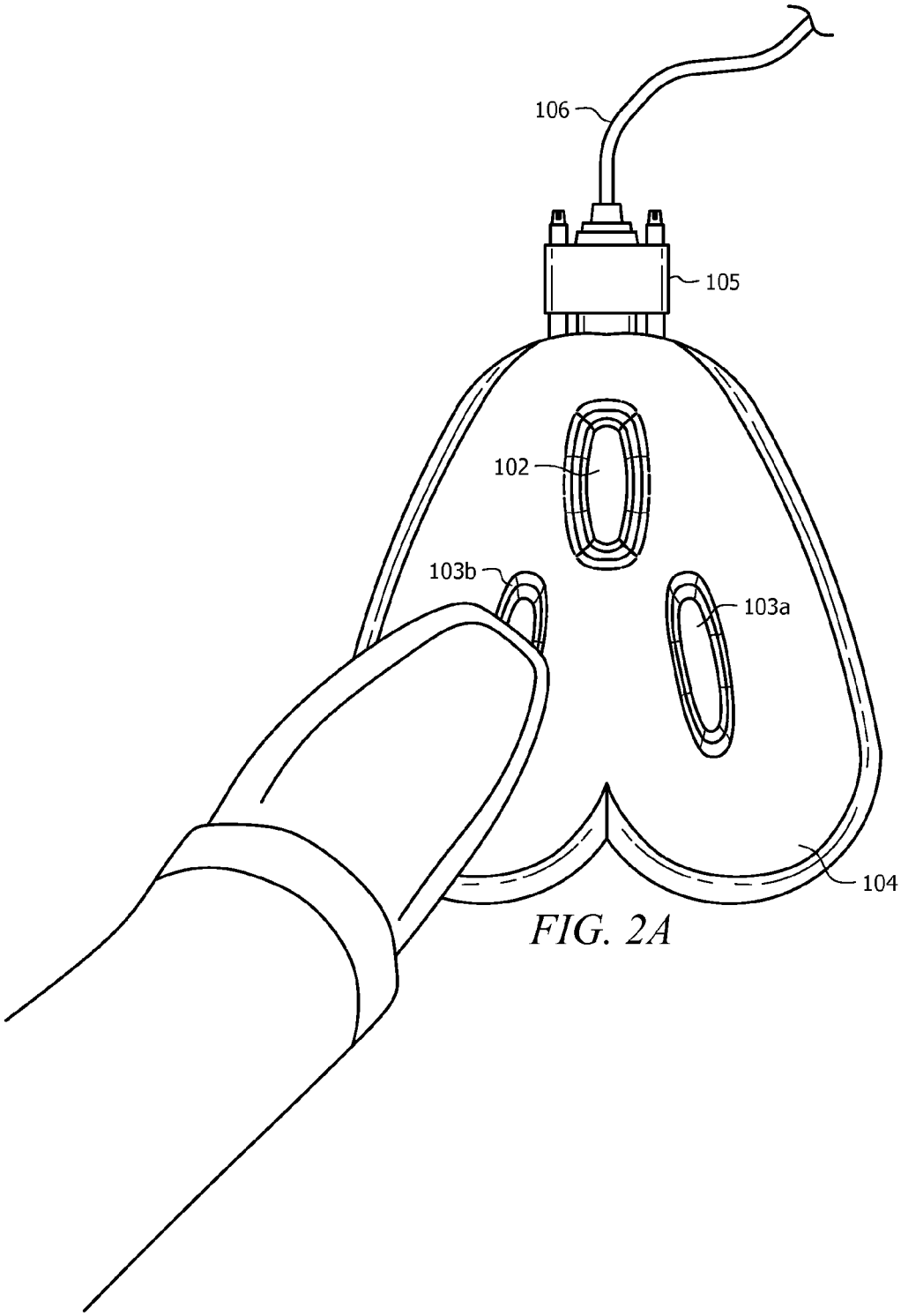
FIG. 2A depicts operation of the human interface device of FIG. 1A according to an embodiment of the present disclosure.
Figure 2B:
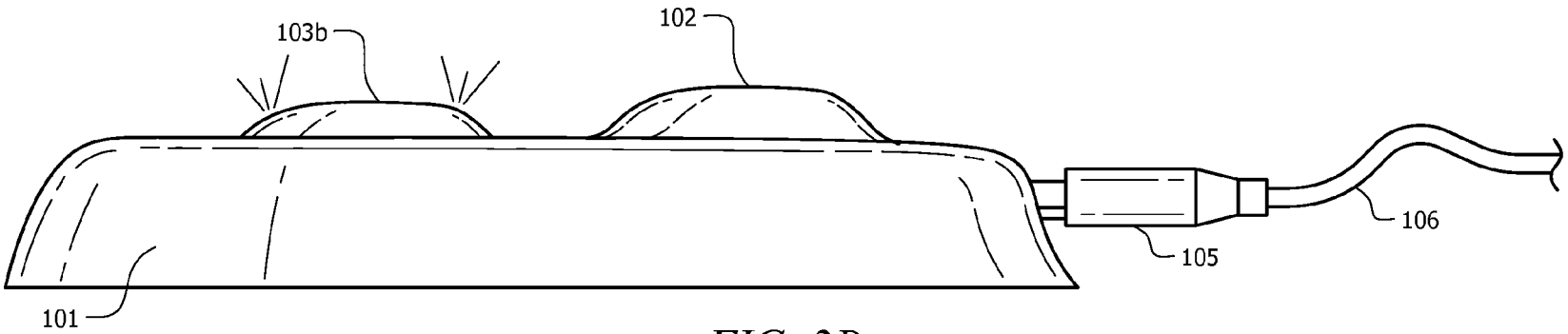
FIG. 2B depicts a side view of the human interface device of FIG. 1A when in operation according to an embodiment of the present disclosure.

FIG. 2A depicts operation of human interface device 10 according to an embodiment of the present disclosure. In this embodiment, a user's foot may place pressure on a pressure surface or bump around OTA 103*b* in order to operate human interface device 10. FIG. 2B depicts a side view of human interface device 10 wherein pressure is being applied to the pressure surface or bump around OTA 103*b*. FIGS. 2A and 2B further depict a cable affixed to receiver 105 to attach, for example, to a musical instrument.

Figure 3:
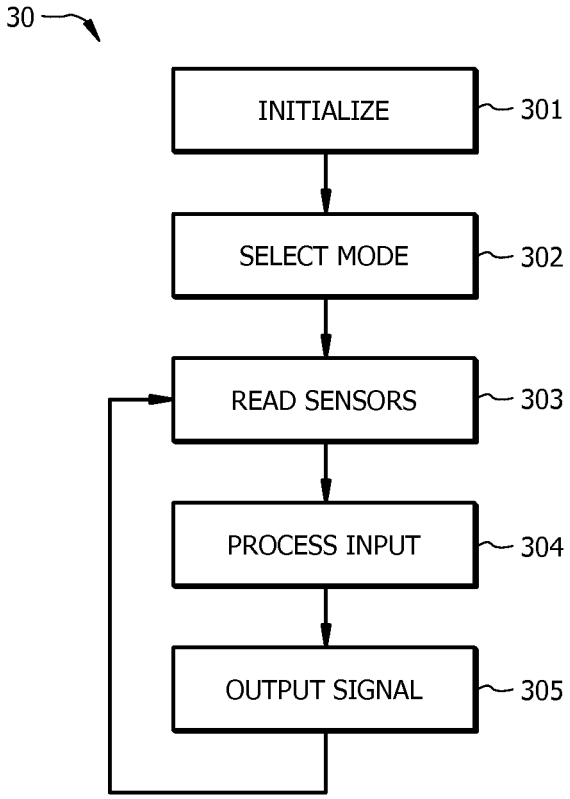
FIG. 3 depicts a control program for operating a human interface device according to an embodiment of the present disclosure.

FIG. 3 depicts control program 30 for operating a human interface device according to an embodiment of the present disclosure. Human interface device may be initialized (301). A mode may be selected (302). Sensors may be read (303), inputs may be processed (304) and then a signal may be outputted (305). It should be appreciated that steps 303-305 may be repeated as many times as is desired to produce signal output according to embodiments of the present disclosure.

Figure 4:
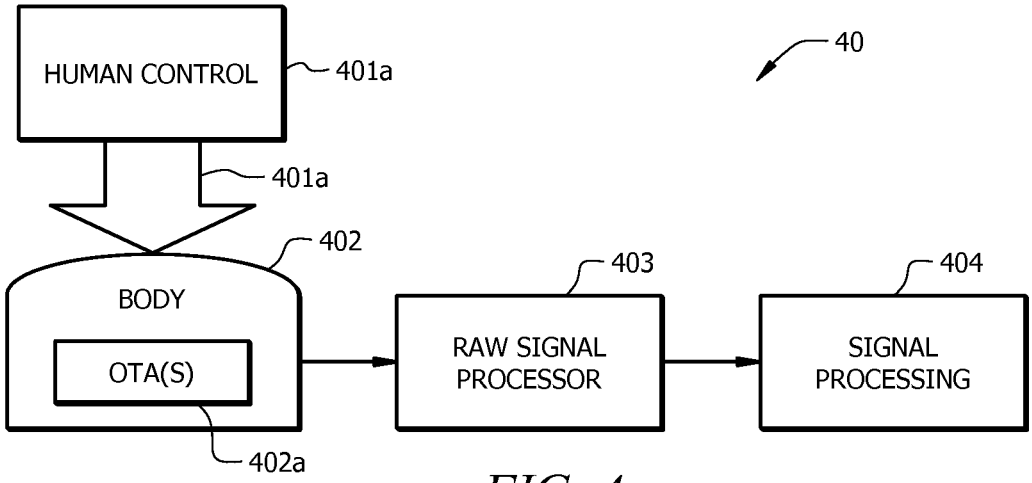
FIG. 4 depicts a signal path according to an embodiment of the present disclosure.

FIG. 4 depicts signal path 40 according to an embodiment of the present disclosure. Human control element 401 may exert pressure 401*a* on body 402 containing one or more of optical tube assembly (OTA) 401*a*. Body 402 may house and protect one or more OTAs and may present a playing surface for human control element 401. Body 402 also may focus pressure and provide a means for the user to communicate. There may be at least one OTA within body 402 that may receive pressure as an input and then output GND and raw signal.

Once pressure 401*a* has been exerted, raw signal processor 403 may accept and invert sensor input from one or more OTA 401*a*. It should be appreciated that raw signal processor 403 may be a sensor circuit that is efficient and may be dark-activated. Raw signal processor 403 may be a voltage divider circuit and, as such, may receive input such as voltage from OTA 401*a* and then output GND or other signals. It also should be appreciated that raw signal processor 403 may be formed integrally with body 402 or may be housed in a separate unit without departing from the present disclosure.

Signal processing unit 404 may be referred to as an effects circuit and may use sensor input received from raw signal processor 403 to generate or apply the desired effect or output. It should be appreciated that the desired output may include but is not limited to MIDI, analog inline, or VST plug-in. It also should be appreciated that signal processing unit 404 may be integrated with or separate from raw signal processor 403 without departing from the present disclosure.

An OTA may be mounted within the body of a human interface device through various means including but not limited to hair trigger, hard candy and wave shape techniques. These various means are described below with respect to FIGS. 5, 6 and 7.

Figure 5A:
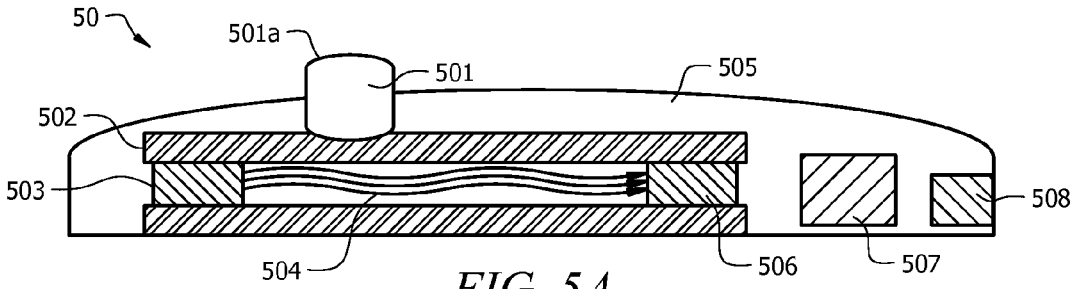
FIGS. 5A-5C depict a human interface device including an OTA mounted through a hard candy technique according to an embodiment of the present disclosure.
Figure 5B:
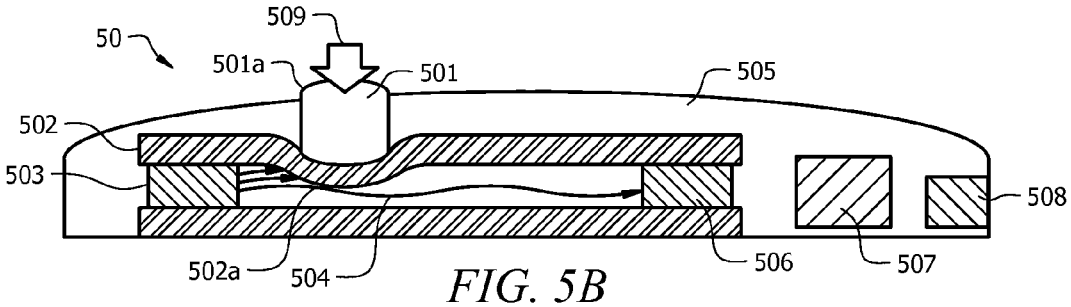
Figure 5C:
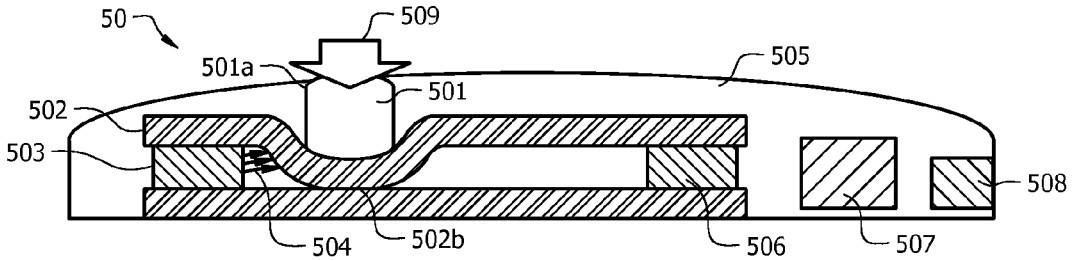

FIGS. 5A-5C depict device 50 that may include body 505 wherein an OTA is mounted through a hard candy technique according to an embodiment of the present disclosure. Using a hard candy technique, a focuser may be presented directly as the pressure surface that compresses a straight OTA at the bottom of the body of the human interface device. Control mechanism 501 is the focusing aid in this embodiment of the present disclosure and may be considered the "hard candy."

In embodiments of the present disclosure, a control mechanism may translate the variable surface area of the user contact area (such as the bottom of a shoe) with contact on the OTA. It may transfer and focus pressure on the best-performing spot of the OTA and decrease the user's required range of motion. Control mechanism 501 may include pressure surface 501*a*. Control mechanism 501 may be comprised of a top portion, a shaft portion, and a tip portion. It should be appreciated that these portions may be optimized in size, shape, and material, particularly, that the top portion may be optimized to present the ideal pressure surface to the operator, and that the shaft portion may be optimized to provide for the required range of motion, motion-limiting stoppage, and securement to the surrounding body, and that the tip portion may be optimized to press on the OTA below.

Body 505 may house electronics 507 and output 508 as well as an OTA that may include tube wall 502, emitter 503, and sensor 506. Light 504 may travel through OTA between emitter 503 and sensor 506.

The OTA may be formed of a tube (including tube wall 502) that may be comprised of a soft elastomeric material, such as silicone rubber, having an inside diameter that may range from 3-5 mm with a length of 5-20 cm. However, it should be appreciated that the tubes may scale up or down in size without departing from the present disclosure. This soft tube may act as an optical conduit wherein light may bend with the tube such that the sensor head may not need to concentrate the light, thereby countering some of the inverse-square law with the fiber-optic effect. The log versus inverse-square curve may make a "sweet spot" for control based on the illumination and the performance of the darkened range just below the maximum illumination of the sensor. The size may be tuned to occupy the maximum range size that will comply with the performance requirements, and a maximum of 6 ms performance may be achieved before it may begin to sound laggy.

It should be appreciated that the tube may be formed independently of body 101 or may be integrated with body 101 according to embodiments of the present disclosure. Dependent tubes may be formed by a rod being placed within the mold being used to form body 101. The tubes should be opaque to outside light. In some embodiments of the present disclosure, the tube may be directly exposed as the playing surface of device 10, but in other embodiments of the present disclosure, the tubes may not visibly protrude from body 101. It should be appreciated that the tubes may be straight, may be vented to avoid tube collapse, and may be the same or different hardness as the material forming body 101 according to embodiments of the present disclosure.

The core of the head of emitter 503 may be a light-emitting diode (LED) that may radiate or emit a bright (approximately 8-13 candela) focused (approximately 10-20 degree) radiant light at the peak sensitivity of the sensor (approximately 580 nm wavelength) through a tube in an elastic-type body where it may be detected by sensor 506. The LED may be collimated to point off-axis down the tube away from the direction of the bend. This may avoid undesirable brightening of the sensor during operation and may allow a smooth darkening without the "bump" of light.

The LED may emit the same light to which sensor 506 is most sensitive. In some embodiments of the present disclosure, that light may be within the range of 580 nm ("bright yellow") at a brightness of about 8-13 candela. Emitter 503 may include a short spacer that may be placed directly behind the head of emitter 503 and then a long spacer at the back of emitter 503. There may be a gap between the short spacer and the long spacer to house a solder joint wherein the positive and negative leads of the LED may be soldered through the long spacer. It should be appreciated that the spacers and gaps within emitter 503 may be saturated with hot glue (HMA), and heat-shrink tubing may tightly wrap the components forming emitter 503 which may force the hot glue into gaps within emitter 503.

The core of the head of sensor 506 may be a light-dependent resistor (LDR) or photocell according to embodiments of the present disclosure. For example, a sensor may be a CdS LDR with a fall time of approximately 5 milliseconds according to an embodiment of the present disclosure. The LDR may be sensitive to the same light that may be emitted by the LED within emitter 503. A short spacer may be placed directly behind the LDR with the leads trimmed, and then there may be a long spacer at the back with a gap between the short spacer and the long spacer to house the solder joint. As in emitter 503, the positive and negative leads of the LDR may be soldered through the long spacer, and the spacers and gaps may be saturated with hot glue (HMA) with heat-shrink tubing tightly wrapping the components forming sensor 506, thereby forcing the HMA into the gaps.

As positive pressure is applied from above, the tube may be pinched shut and this may progressively obscure more of the light from the emitter. The inverse of the sensor reading between zero and the maximum may correlate to the amount of positive pressure being applied. The light sensor analog output may then be used to control another signal, such as the amount of volume by which an audio signal should be adjusted. Resistive pressure increases as pressure on the device increases, providing a direct and consistent feedback mechanism from which the user may adjust the pressure applied according to the result of the controlled signal, e.g., an audio feedback loop for a guitar effect being adjusted as the guitar is being played.

Sensor output may be measured in response to gradually increasing pressure with the same footprint. It should be appreciated that the logarithm of the resistance grows smoothly as pressure is increased. It has been determined that there may be a range of approximately 90 grams of pressure which is an extensive range to resolve into as many shades of pressure as may be desired so that pressure may be applied with just enough feedback from the human interface device that it is moving. The entire depression may be in the range of 4-5 mm. The response time for a human interface device may be limited by the fall time of the sensor. The fastest photocell may provide a fall time of 5 ms from full illumination to maximum resistance (approximately 100K Ohms). The longer the range, the easier it is for the device to keep up with the user, and the user may feel little to no delay going from zero to full gate. In an embodiment of the present disclosure, the sensor may be a "fast" light-dependent resistor that may operate about 10 times faster than other known photocells. Accordingly, devices according to embodiments of the present disclosure do not need to outdistance the listener's ear, only the user's foot. It should be appreciated that the working range may be greater with an equally smooth response curve by further optimizing the characteristics of the OTA components according to embodiments of the present disclosure.

FIG. 5A depicts control mechanism 501 in an open gate state. When control mechanism 501 is in an open gate state, it should be appreciated that no pressure is being applied to operate the device and accordingly all of light 504 may reach sensor 506. In contrast, FIG. 5B depicts control mechanism 501 in a partial gate state as pressure 509 is being applied to control mechanism 501. In this embodiment of the present disclosure, some of light 504 may reach sensor 506, but other light may be blocked by portion 502*a* of tube wall 502. FIG. 5C depicts control mechanism 501 in a full gate state as more pressure is being applied to control mechanism 501. In this embodiment of the present disclosure, none of light 504 may reach sensor 506 insofar as portion 502*b* of tube wall 502 is blocking light 504 from traveling through the OTA to sensor 506.

When the sensor within an OTA of a human interface device is otherwise shielded from incidental light, a "zero"

sensor reading would indicate the human interface device is in the "down" position. Likewise, a "maximum" reading would indicate that the human interface device is in the "up" position. Accordingly, graduations of sensor output may reflect the amount of positive pressure applied at a given time to the human interface device.

Figure 6A:
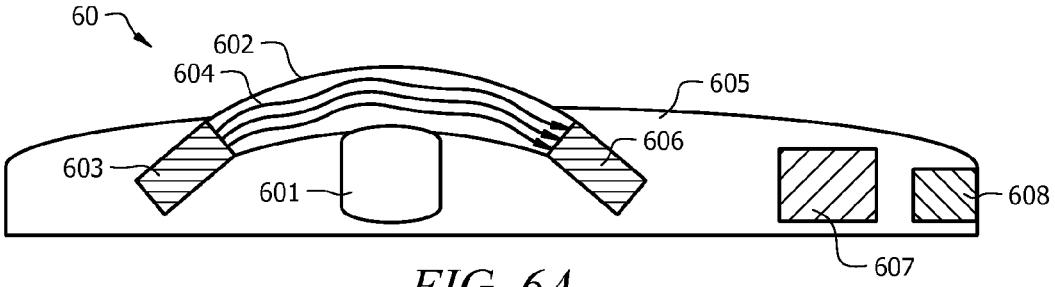
FIGS. 6A-6C depict a human interface device including an OTA mounted through a hair trigger technique according to an embodiment of the present disclosure.
Figure 6B:
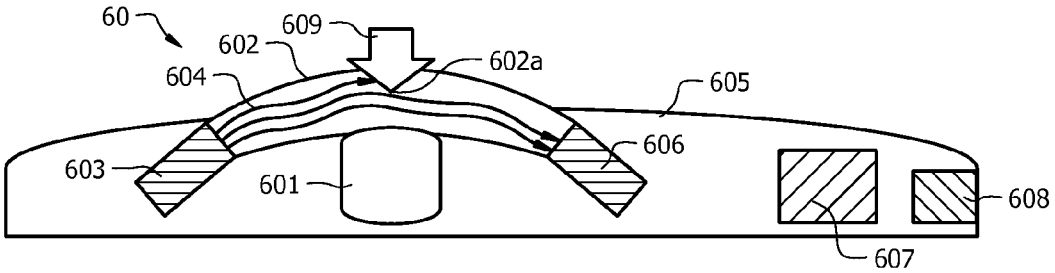
Figure 6C:
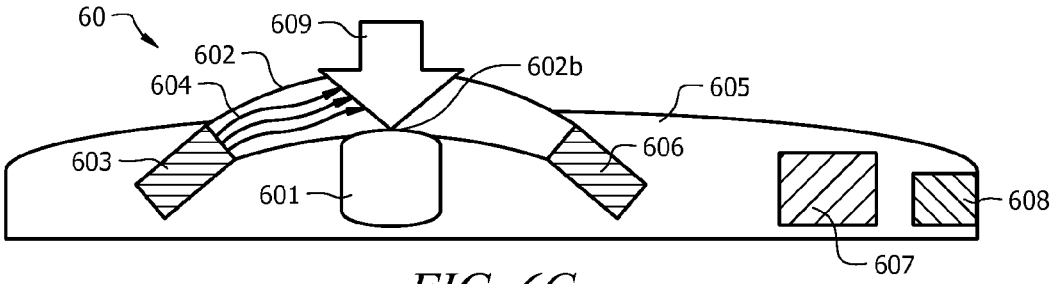

FIGS. 6A-6C depict device 60 that may include body 605 wherein an OTA is mounted through a hair trigger technique according to an embodiment of the present disclosure. Using a hair trigger technique, a curved OTA may be presented directly as the pressure surface with a focuser placed underneath. In this embodiment, tube wall 602 may be exposed as the control mechanism for device 60 and may be curved almost to the point of kinking. As previously described with respect to FIGS. 5A-5C, body 605 may house electronics 607 and output 608 as well as an OTA that may include tube wall 602, emitter 603, and sensor 606. Body 605 may include two left-right bumps as well as a middle bump as part of the top surface of body 605. The bumps may be formed to provide a natural curve of emitter obstruction based on positive pressure applied to the top of the device. Natural may refer to the logarithmic scale for approximating natural ranges of vision, ranges of muscle motion, and other aspects of human motions and senses. There may be an arch just under the left-right bumps with a rod-style or hard candy-style focuser, such as focuser 601 underneath. Light 604 may travel through OTA between emitter 603 and sensor 606. However, in this embodiment of present disclosure, focuser 601 may be positioned beneath the OTA. Using a hair trigger technique, pressure may be applied directly to the OTA in order to control device 60.

FIG. 6A depicts an open gate state. When in an open gate state, it should be appreciated that no pressure is being applied to operate device 60 and accordingly all of light 604 may reach sensor 606. In contrast, FIG. 6B depicts a partial gate state as pressure 609 is being applied to the OTA. In this embodiment of the present disclosure, some of light 604 may reach sensor 606, but other light may be blocked by portion 602*a* of tube wall 602. FIG. 6C depicts a full gate state as more pressure is being applied. In this embodiment of the present disclosure, none of light 604 may reach sensor 606 insofar as portion 602*b* of tube wall 602 is completely compressed, thereby blocking light 604 from traveling through the OTA to sensor 606.

Figure 7A:
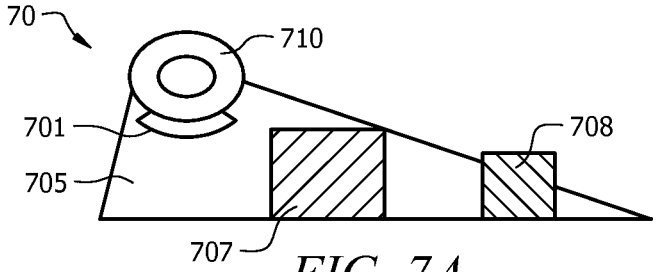
FIGS. 7A-7C depict side views of a human interface device wherein an OTA is mounted through a wave technique according to an embodiment of the present disclosure.
Figure 7B:
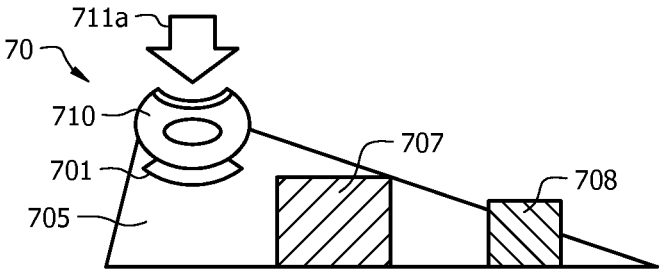
Figure 7C:
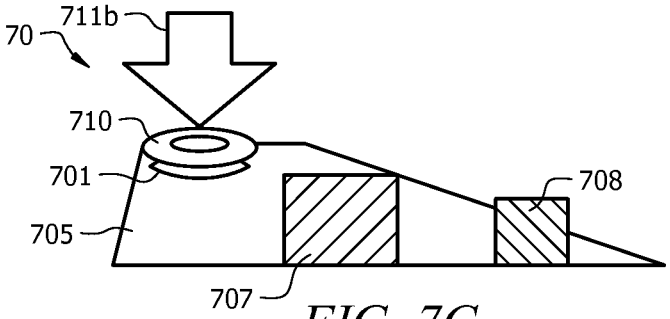

FIGS. 7A-7C depict side views of device 70 wherein an OTA is mounted through a wave technique according to an embodiment of the present disclosure. Using a wave technique, a straight OTA may be placed atop a wedge shaped device with the focuser placed underneath, thereby presenting at least 180 degrees of the OTA as a pressure surface. In these side views, only the end of OTA 710 is depicted, but it should be appreciated that OTA 710 may be constructed in a manner similar to that described with respect to FIGS. 6A-6C wherein focuser 701 is positioned beneath OTA 710 and the control mechanism is OTA 710 at the top of body 705. Body 705 also may include electronics 707 and output 708.

FIG. 7A depicts an open gate state. When in an open gate state, it should be appreciated that no pressure is being applied to operate device 70 and accordingly all of the light moving through OTA 710 may travel from the emitter to the sensor within OTA 710. In contrast, FIG. 7B depicts a partial gate state as pressure 711*a* is being applied to OTA 710. In this embodiment of the present disclosure, some of the light traveling from the emitter may reach the sensor within OTA 710, but a portion of the tube wall forming OTA 710 may block other light from reaching the sensor. FIG. 7C depicts a full gate state as more pressure 711*b* is being applied. In this embodiment of the present disclosure, none of the light traveling through OTA 710 may reach the sensor insofar as the tube wall is completely compressed, thereby blocking the light from traveling through OTA 710 to the sensor.

It should be appreciated that while embodiments have been described as having a single OTA, devices may be provided with more complex control having multiple OTAs according to embodiments of the present disclosure. In an embodiment of the present disclosure, a two-pair system may be provided representing an up-pitch and a down-pitch of a pitch bend control. Each emitter/sensor pair may control a separate aspect of the effect, e.g. an "up-pitch" control and a "down-pitch" control. Pressure applied to either pair may alter the pitch up or down respectively according to a defined or controlled range. By modeling a hand-driven pitch-bend wheel commonly found on MIDI controller keyboards, devices according to embodiments of the present disclosure may drive the pitch up and down, thereby freeing the user's hands. It should be appreciated that the controls may operate independently of one another, but there also may be interaction between the controls. In an embodiment of the present disclosure, two emitter/sensor pairs may be contained within the same body such that a single point of pressure applied to the top of the human interface device may cause changes to both sensors. In this instance, some portion of the human interface device may be pressed near both emitter/sensor pairs. In another embodiment of the present disclosure, if the pressure point is further away from one of the sensors, only one of the sensors may detect a change. As will be described in further detail below, various numbers of emitter/sensor pairs may be provided within a human interface device according to embodiments of the present disclosure. A three-pair system, for example, may be arranged in a triangle and embedded within a body. Pressure in a central portion of the body may result in all three sensors detecting a change with the sensor closest to the pressure point registering the most change. If only one sensor registers a change, this may indicate that the pressure point is located centrally to that emitter/sensor pair's pressure domain. Otherwise, one of the two other sensors should also detect a change. Similarly, sensor changes on two adjacent pairs may indicate that the pressure point was positioned near the junction of those pairs. It should be appreciated that this pair/zone detection may be expanded to a low-resolution "touch-screen" detection wherein zones may be provided that roughly equate to pixels. Accordingly, more zones may be sensed than there are pairs, depending on the configuration of OTAs within a human interface device according to embodiments of the present disclosure.

Exploitation of pressure domains within a human interface device may present the maximum unobstructed OTA directly to the user. In embodiments of the present disclosure, the pressure domain should be at least 120 degrees for adequate response. A zone map should be provided that is sufficient to identify intuitive human gestures and to shift between control and value modulation. The user may vary the range of control versus the amount of pressure applied, thereby allowing the user to employ a light touch or a heavy touch subject to the user's control. This may be enhanced by making multiple devices with varying ranges of sensitivity—i.e., delicate sensitivity for a lighter feel and less sensitivity for a heavier feel, ostensibly corresponding to vectors such as the weight, type of footwear, and playing technique of the user.

Figure 8A:
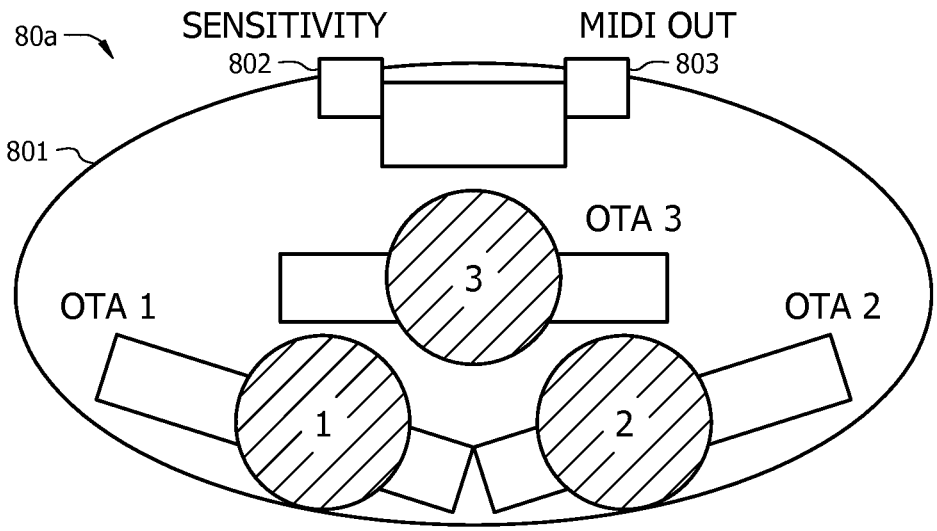
FIG. 8A depicts an embodiment of a human interface device having 3-OTA independent configuration.

FIG. 8A depicts an internal view of human interface device 80*a* according to an embodiment of the present disclosure. In this embodiment, there may be three OTAs (OTA 1, OTA 2, OTA 3) and three corresponding pressure surface areas 1, 2, 3 within body 801. Human interface device 80*a* also may include sensitivity control 802 and MIDI out 803. It should be appreciated that the size of the working range may be exposed to the user with sensitivity control 802. The user may directly compress the ratio of his/her input to the amount of output. A very small working range may equate to a high sensitivity, as input from the human interface device may be compressed into fewer graduations on the output. The highest sensitivity may turn any graduated function into an on-off mode. The lowest sensitivity may be in the range of about 20 ms or about 630 graduations; however, the lowest sensitivity may vary (i.e., may be lower or higher than this range) without departing from the present disclosure. It should be appreciated that the range of about 20 ms is not an audio delay but rather user delay. The audio delay may be limited to about 5 ms according to embodiments of the present disclosure. The user may be provided with a range on sensitivity control 802, such as a simple scale from 1-10 according to embodiments of the present disclosure. Near the highest sensitivities, where the upper limit is approximately 5 or less, the MIDI signals may begin their output within 1 ms of the user's movement according to embodiments of the present disclosure.

Figure 8B:
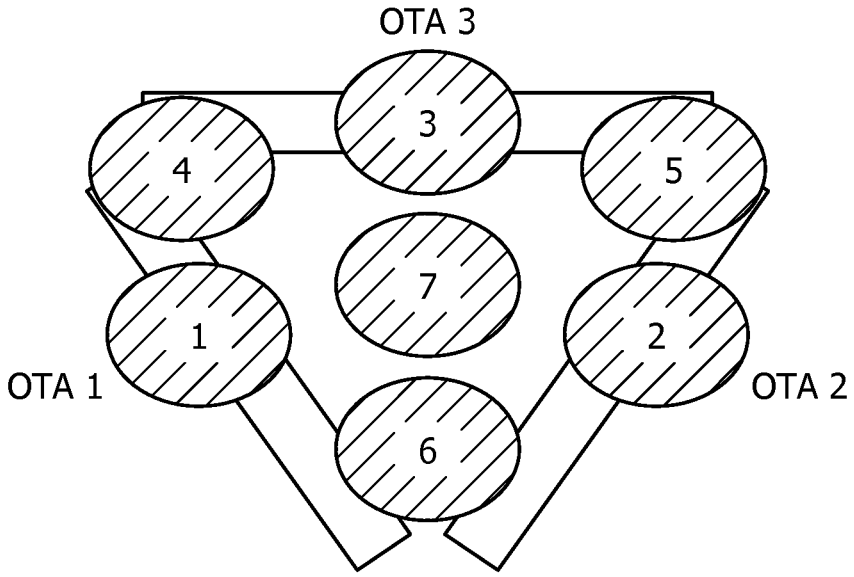
FIG. 8B depicts another embodiment of a human interface device having a 3-OTA dependent configuration.

Human interface device 80*a* may provide several selectable presets of MIDI controls according to embodiments of the present disclosure. In a first mode, there may be latched pitch bend on pressure surface areas 1 and 2 with pressure surface area 3 being sustain control. When referring to latching, this may mean that once the OTA associated with the pressure surface area is activated, the other OTA(s) may be ignored until the active OTA returns to an open-gate state, thereby preventing crosstalk jitter. In a second mode, there may be latched pitch bend on pressure surface areas 1 and 2 with a MOD wheel on pressure surface area 3. In a third mode, there may be MOD wheel on pressure surface area 1, expression on pressure surface area 2 and breath on pressure surface area 3. FIG. 8B depicts another embodiment of a human interface device having a 3-OTA configuration. In this embodiment, there may be 7 different zones that may reflect when one or more of the OTAs may be in operation.

Figure 9:
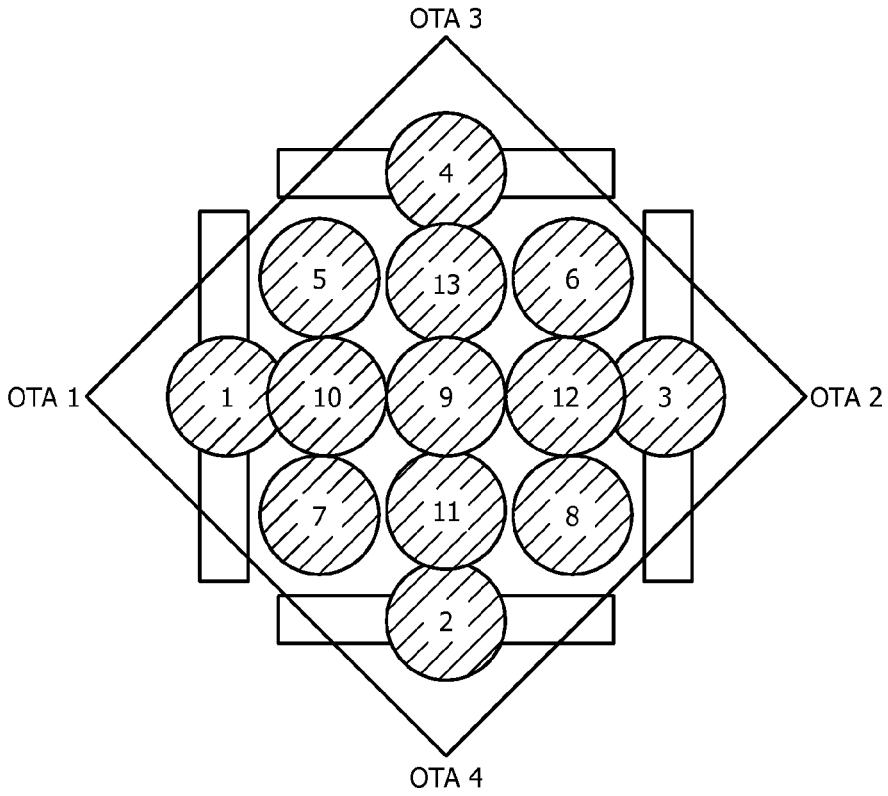
FIG. 9 depicts a human interface device having a 4-OTA configuration according to an embodiment of the present disclosure.

FIG. 9 depicts a human interface device having a 4-OTA configuration according to an embodiment of the present disclosure. In this embodiment, there may be 13 different zones that may reflect when one or more of the OTAs may be in operation. For example, in position 1, only OTA1 may be in operation while in position 9, each of the 4 OTAs may be in operation. The chart below reflects the different configurations that may be provided for in a 4-OTA configuration according to embodiments of the present disclosure.

| Position | OTA1 | OTA2 | OTA3 | OTA4 |
|---|---|---|---|---|
| 1 | Y | N | N | N |
| 2 | N | N | N | Y |
| 3 | N | Y | N | N |
| 4 | N | N | Y | N |
| 5 | Y | N | Y | N |
| 6 | N | Y | Y | N |
| 7 | Y | N | N | Y |
| 8 | N | Y | N | Y |
| 9 | Y | Y | Y | Y |
| 10 | Y | N | Y | Y |
| 11 | Y | Y | N | Y |
| 12 | N | Y | Y | Y |
| 13 | Y | Y | Y | N |

Figure 10A:
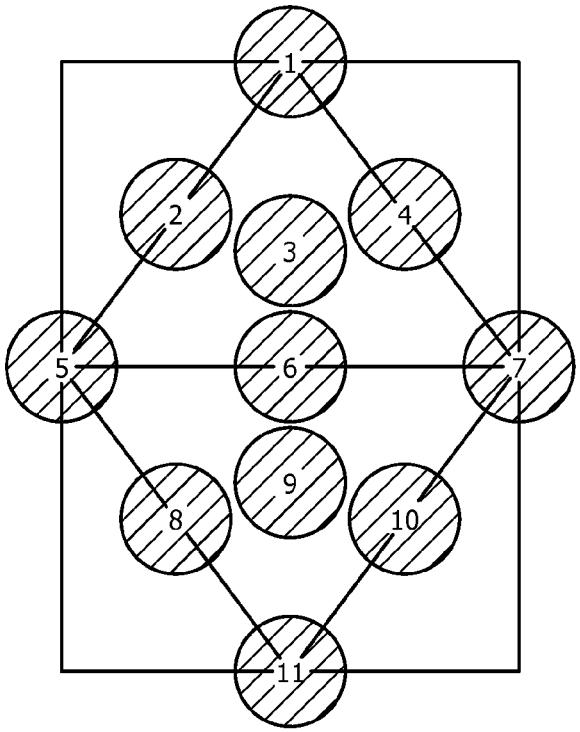
FIG. 10A depicts a human interface device having a diamond configuration according to an embodiment of the present disclosure.
Figure 10B:
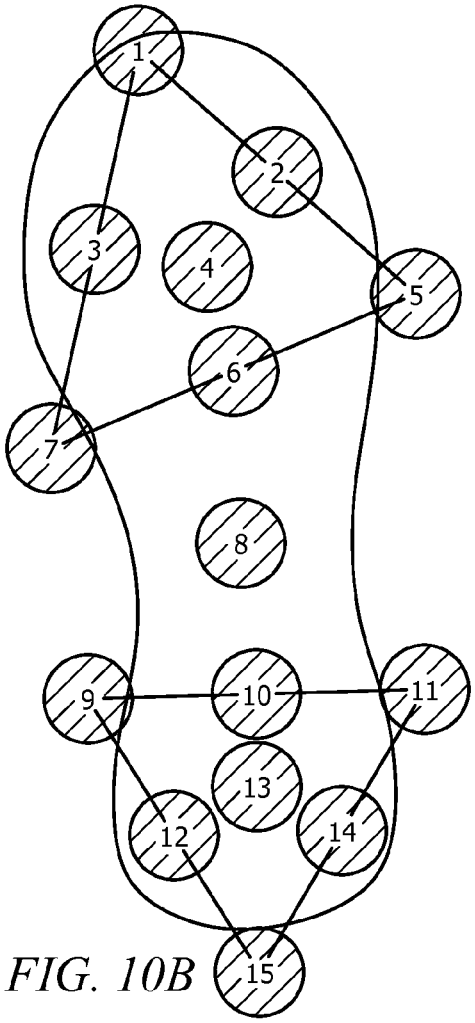
FIG. 10B depicts a human interface device having a foot configuration according to an embodiment of the present disclosure.
Figure 10C:
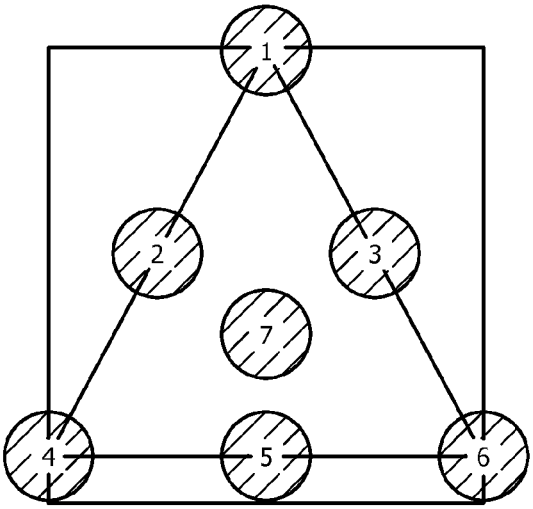
FIG. 10C depicts a human interface device having a basic triangle configuration according to an embodiment of the present disclosure.
Figure 10D:
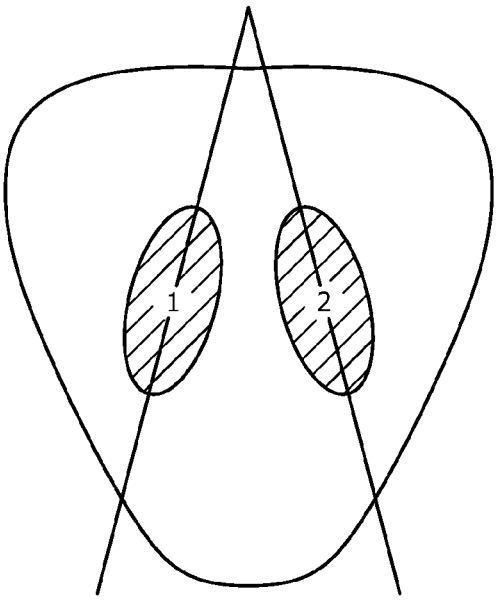
FIG. 10D depicts a human interface device having a 2-lobe "alien" configuration according to an embodiment of the present disclosure.
Figure 10E:
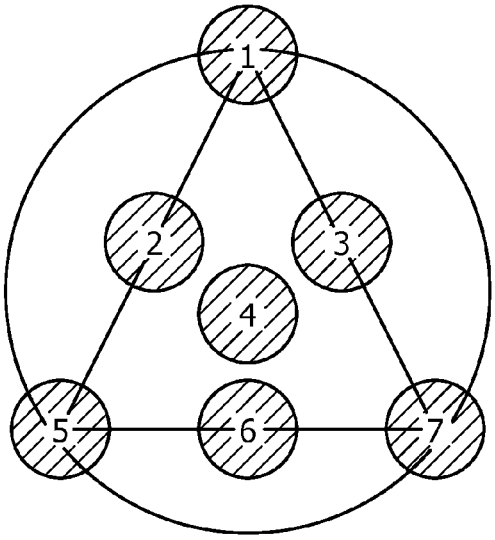
FIG. 10E depicts a human interface device having a basic triangle configuration according to an embodiment of the present disclosure.
Figure 10F:
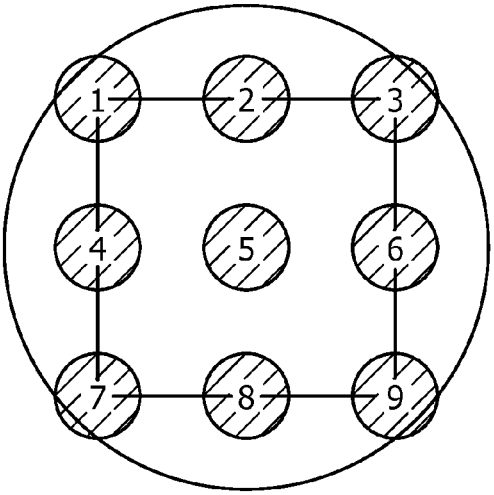
FIG. 10F depicts a human interface device having a basic square configuration according to an embodiment of the present disclosure.
Figure 10G:
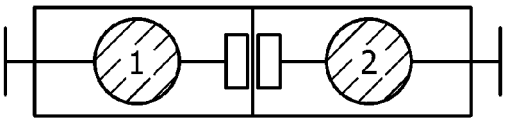
FIG. 10G depicts a human interface device having a tee configuration according to an embodiment of the present disclosure.
Figure 10H:
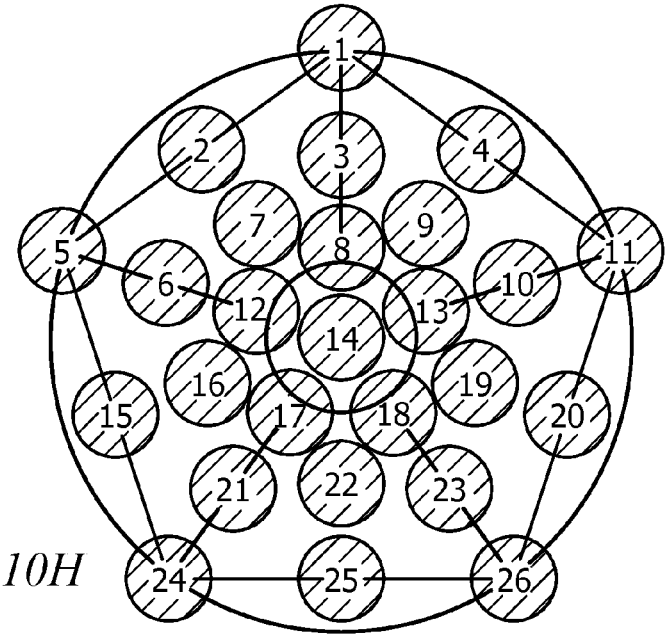
FIG. 10H depicts a human interface device having a drum donut configuration according to an embodiment of the present disclosure.

FIGS. 10A-10H depict additional OTA and body configurations for a human interface device according to embodiments of the present disclosure. FIG. 10A depicts a diamond configuration including 8 zones and 6 OTAs. FIG. 10B depicts a foot configuration that may include 15 zones and 6 OTAs. FIGS. 10C and 10E depicts a basic triangle configuration having 7 zones and 3 OTAs. FIG. 10D depicts a 2-lobe "alien" configuration having 2 zones and 2 OTAs with no overlap. FIG. 10F depicts a basic square configuration having 4 OTAs and 9 zones that may be equally spaced apart. FIG. 10G depicts a tee configuration that may be used for a handheld device, for example, and it may include sensors on the far ends of the device. FIG. 10H depicts a drum donut configuration having 25 zones and 10 sensors. It should be appreciated that by varying the arrangement of n OTAs relative to each other and by monitoring each OTA, it may be possible to infer more than 2n pressure points using only binary gradations. It also should be appreciated that while various configurations have been depicted and described, other configurations may be available without departing from the present disclosure. It may be further appreciated that there may be no overlap between OTAs to create a human interface device with as much or more topological granularity as a matrix-type device by using a properly clever map of sensor output to a zone map.

It should be appreciated that regardless which configuration a human interface device takes, the types of interaction with the human interface device may take on different forms. For example, a given sensor pair may vary in function depending on several variables, including but not limited to unidirectional control, bidirectional control and gestures. Unidirectional control may refer to when only positive pressure moves a control. For example, with a gain control, two pairs may act as the up and down control. As long as positive pressure is applied to one of the sensors, the gain may be increased or decreased. However, a decrease in pressure may be ignored, effectively pinning the gain at the level where the most pressure was applied. Activating the opposite control may reverse the direction of the gain, but in the same way, increasing the control as long as positive pressure is progressively applied to that pair but not decreasing the effect once the pressure recedes. Bidirectional control may refer to when both positive and negative pressure affect the control. For example, this may be a pitch-bend control implementing two pairs, one for "up pitch" and the other for "down pitch." Positive pressure applied to the "up pitch" pair would raise the pitch but as pressure is released, the pitch should reverse direction and return to neutral once pressure is completely released. Likewise, the "down pitch" pair would alter the pitch down, commensurate with a positive pressure consistently and progressively applied downward on to the top of the pedal to lower pitch down to the maximum and then back up again as pressure is released. Some special gestures may be applied that may not be confused with artistic expression necessary for broad control and switching between multiple effects. This may be used when there are more than a few zones so that there may be less confusion as to the meaning of the gesture. For example, a three-pair system may allow for expressive articulation and unambiguous control functions simultaneously. One zone may serve as a switch to a different mode or effect. Once a control zone has been activated, other zones may function differently. For example, two pairs may control up and down pitch in effect-pitch-bend mode, and control left and right pan for a stereo-related effect, and control "up and down" to scroll through a list of choices in another mode. All choices may be possible with the combination of flexible zone recognition and application reaction.

It should be appreciated that human interface devices according to embodiments of the present disclosure may be used for controlling any kind of human-modulated signal, particularly audio signals, and producing various effects, including but not limited to sounds, volume, gain control, and pitch bend. Devices may be formed as a pedal/stomp box to control the signal and alter live or recorded play. Devices may provide control for microphones, electrical musical instruments and MIDI controllers, pedals, percussion surfaces, among other sound-producing implements. Additional applications may include but are not limited to television and other remote control devices using line-of-sight photonic signaling or an active IR attachment (such as TV, audio and video equipment), as well as pedals, plugins, DJ/MIDI controller surfaces, and new musical instruments based on non-audio signal processing. A foot-operated floor-based human interface device may be provided as well as a hand or foot operated percussive surface (i.e., drum head or cymbal). Other devices that may be worn or strapped onto the body also may be provided according to embodiments of the present disclosure. While a human interface device may be implemented as a USB-connected device, it should be appreciated that it also may be implemented as an in-line connection (i.e., with instrument cables) as is common with guitar pedals or as a MIDI connection according to embodiments of the present disclosure. Software may then be used to interpret the incoming sensor changes and present the data in a useful and generic manner. As such, human interface devices according to embodiments of the present disclosure may modulate pitch bend (16384 graduations) and any other MIDI function (generally 127 graduations) to a trained human ear with complete smoothness.

As previously described, human interface devices according to embodiments of the present disclosure may be operated by a user's foot. It should be appreciated, however, that the human foot rest weight varies widely. It is believed that 75% of people will rest from 2-5 kg on the front or ball of their foot, in a standing position, with their playing foot shifted slightly forward. Such a weight on human interface devices according to embodiments of the present disclosure will not necessarily activate the device but it will be ready for operation at a slight extra touch of pressure. Accordingly, the user's muscles may barely flex in order to operate a human interface device effectively according to embodiments of the present disclosure. It also should be appreciated that additional pressure up to approximately 1 kg will operate the device down to full gate, but the resistance may increase slightly the closer to full gate the device is. The optimal working range of the photocell's performance may be reached by varying the start and size of the sensor input range and the brightness of the LED and/or the distance from the LED to the sensor.

Embodiments of the present disclosure also provide profile improvement. Less height is needed to operate the functions of a human interface device according to embodiments of the present disclosure when compared to traditional pedals that may range from greater than 1 inch to several inches in height. A human interface device may allow a seated guitar player to use the same leg/foot to rest his/her guitar and operate the device simultaneously. Further, since human interface devices according to embodiments of the present disclosure require much less physical range of movement to operate, while still providing greater control, this makes it possible for seated users to use where the user's dominant foot (the "tapping" foot) can use the device in time with the music being played. Unlike traditional pedals, operation of devices according to embodiments of the present disclosure require sufficiently little motion so as to allow a guitar player to rest the guitar on his/her tapping leg and still play the guitar without regard to the up-and-down oscillation produced by doing so with a taller device with a less natural motion. It also should be appreciated that devices according to embodiments of the present disclosure may be provided as an accessibility device for persons for whom the existing pedals may present a physical challenge in use.

Embodiments of the present disclosure also may improve operational usage ergonomics. While improving control, human interface devices according to embodiments of the present disclosure may simultaneously reduce the amount of motion required as well as the amount of difference between the feet with one foot operating such a device. The ergonomic benefit may be substantial for users who spend several hours per day with their feet in asymmetrical positions. This is amplified for users who already wear less than comfortable shoes—for example, it can be difficult to operate a fulcrum-type pedal in high heels and remain dignified during a performance.

It should be appreciated that the resolution provided through human interface devices according to embodiments of the present disclosure may be limited only by the resolution of the sensors. Speed is important so smaller working ranges may be used on the hardware and software side to ensure that speed is not sacrificed. It should be appreciated that a variety of different sensor paths may be used in connection with human interface devices according to embodiments of the present disclosure. For example, Arduino is a rapid prototyping system for implementing physical computing in connection with a human interface device. A USB sensor interfacing kit and API may be used to control a VST plug-in. An inline sensor path comprised of ¼inch cables, such as guitar instrument cables, may be used for an inline human interface device, such as a wah pedal. An instrument may be plugged into the human interface device, and the human interface device may connect with a second cable to the input, such as an amplifier or PA system. The human interface device also may be configured to output to any type of MIDI control signal according to embodiments of the present disclosure. Any of these paths may include a wireless component without otherwise affecting the rest of the signal path.

It follows that human interface devices according to embodiments of the present disclosure may allow for player growth, and these devices may respond as expected by both beginners and advanced players. Devices according to embodiments of the present disclosure also may respond evenly to very subtle gestures, without being too "touchy." For example, devices may behave intuitively to experimental and complex gestures such as downward or forward pressure, rotation, and rocking motions of the feet. They also may feel responsive whether played with a light touch or a heavy touch. Further, these devices may allow for playing an instrument, such as a guitar, while seated, i.e., requiring very little range of movement to operate.

Devices according to embodiments of the present disclosure also may be formed to avoid characteristics which detract from perfect function of an instrument, including "bounce," "crosstalk," "jitter," "drift," electronic noise, electromagnetic interference (EMI), subtle detractors of tonal purity and quality, and other artifacts of control interaction, except when desired by the user. Sensitivity adjustment may be provided with devices according to embodiments of the present disclosure, and these devices may operate with all major industry-standard hardware and software.

By combining an emitter with sufficient output, a sensor with sufficient precision and responsiveness, a control mechanism with sufficient human-scale granular control, and a path to connect that control signal to an existing signal path control point, human interface devices according to embodiments of the present disclosure may provide granularity and depth of control, with an as-expected response curve through the entire range of motion of the user's foot on the human interface device. More specifically, embodiments of the present disclosure may provide improved precision of control feedback with greater economy of motion, thereby allowing greater expressiveness and articulation of dynamically applied effects during live or recorded play.

Devices according to embodiments of the present disclosure may provide not only a smaller and more natural range of motion, they also provide not equal but superior ability for expression through effects, especially sweeping-type effects like pitch-bend and wah (variable band pass notching filter). In contrast to fulcrum-type pedals, the response curve of a human interface device according to embodiments of the present disclosure may provide gradual feedback for the user wherein a user may apply a light touch "up top" or "off to the side" of the primary pressure domain or allow for deep expression of emotional play by providing the full response range directly above the pressure domain. Thus, in musical terms, the device "feels good" no matter how light or heavy the user's touch is or what the user's playing style demands. The device accomplishes this by pushing back on the user's foot, due to the stretchy nature of the body, commensurately with the pressure applied. This feedback loop lets the user know continuously where he/she is and the user can merely "think" what he/she wants to do and the device may respond to very small changes in pressure from the foot. Accordingly, the device may have a small range of motion yet still may allow a more tactile connection to the user, exposing a highly granular and responsive "feel" of control.

Embodiments of the present disclosure also may provide improved range of motion compared to traditional fulcrum-type pedals. Accordingly, use of human interface devices according to embodiments of the present disclosure will feel good for the user, allow easier expression as well as more advanced articulation or control of audio signals, including audio signals being produced in real time by an instrument which the user of the pedal is simultaneously playing or post-production where a similar recording is being played back and altered for mixing, mastering or any other kind of playback purposes.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A human interface device for precision control of signal modulation comprising:

a body formed of a durable elastomer capable of rapid compression and having a surface to receive contact from a user; and at least one optical tube assembly (OTA) embedded within the body, each OTA comprising a sensor and an emitter disposed within a soft tube, wherein pressure is applied to one or more pressure surface areas disposed on the body to depress the soft tube within the OTA and obscure light from reaching the sensor of the OTA, and the amount of light received by the sensor selectively effects the signal modulation.

2. The human interface device of claim 1 further comprising:

a raw signal processor that receives an input from the at least one OTA and outputs a sensor signal to a signal processing unit.

3. The human interface device of claim 1 wherein the at least one OTA is mounted within the body through at least one of the techniques selected from the group comprising: hard candy technique, hair trigger technique, and wave shape technique.

4. The human interface device of claim 1 wherein the soft tube is formed of silicone rubber and acts as optical conduit wherein light received by the OTA bends with the soft tube.

5. The human interface device of claim 1 wherein the emitter is a light-emitting diode (LED) that emits a bright focused radiant light at a peak sensitivity to be received by the sensor.

6. The human interface device of claim 1 wherein the sensor is a light-dependent resistor (LDR) that is sensitive to the same light emitted by the emitter.

7. The human interface device of claim 1 wherein the body is formed of room-temperature vulcanization (RTV) silicone rubber.

8. The human interface device of claim 1 further comprising a sensitivity control that adjusts the size of a working range of sensitivity exposed to a user.

9. The human interface device of claim 1 wherein the human interface device controls a device selected from the group comprising:

a musical instrument, a television, a remote control device using line-of-sight photonic signaling or an active IR attachment, a pedal, a plug-in, a DJ controller surface, and a MIDI controller surface.

10. The human interface device of claim 1 wherein the human interface device is foot-operated.

11. The human interface device of claim 1 wherein the human interface device is a percussive surface.

12. The human interface device of claim 9 wherein the human interface device controls the device via a connection selected from the group comprising:

a USB connection, an in-line connection, and a MIDI connection.

13. A human interface device for precision control of signal modulation comprising:

a durable elastomeric body having at least one pressure surface to receive contact from a user; and more than one optical tube assembly (OTA) embedded within the body, each OTA associated with at least one of the at least one pressure surfaces and each OTA including a sensor-emitter pair disposed within a soft tube, wherein when pressure is applied to at least one of the pressure surfaces, the amount of light transferred within a sensor-emitter pair of an OTA is altered to selectively effect the signal modulation.

14. The human interface device of claim 13 wherein the human interface device controls a device selected from the group comprising:

a musical instrument, a television, a remote control device using line-of-sight photonic signaling or an active IR attachment, a pedal, a plug-in, a DJ controller surface, and a MIDI controller surface.

15. The human interface device of claim 13 wherein there are more pressure surfaces than there are sensor-emitter pairs within the human interface device.

16. The human interface device of claim 13 wherein the more than one OTA and the body are formed in a configuration selected from the following:

a diamond configuration, a foot configuration, a triangle configuration, a 2-lobe "alien" configuration, a square configuration, a tee configuration and a drum donut configuration.

17. The human interface device of claim 13 wherein each of the more than one OTA is mounted within the body through a technique selected from the group comprising: hard candy technique, hair trigger technique, and wave shape technique.

18. The human interface device of claim 13 wherein each of the sensor-emitter pairs is in one of the following states when pressure is applied to the body: open gate state, partial gate state, and full gate state.

19. The human interface device of claim 13 wherein the body is formed of room-temperature vulcanization (RTV) silicone polymer.

20. The human interface device of claim 13 wherein the at least one pressure surface is colored differently than the remainder of the body.

* * * * *